US010787906B2

(12) United States Patent
Guo et al.

(10) Patent No.: US 10,787,906 B2
(45) Date of Patent: Sep. 29, 2020

(54) ROADWAY FORMING METHOD BY EXPANDING EXCAVATING AND FILLING GANGUE PASTE IN THICK COAL SEAM

(71) Applicant: SHANDONG UNIVERSITY OF SCIENCE AND TECHNOLOGY, Qingdao (CN)

(72) Inventors: Zhongping Guo, Qingdao (CN); Weizhen Liu, Qingdao (CN); Yong Jian, Qingdao (CN); Huiqiang Duan, Qingdao (CN); Hengze Yang, Qingdao (CN); Wenwu Xie, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/484,651

(22) PCT Filed: May 11, 2018

(86) PCT No.: PCT/CN2018/086556

§ 371 (c)(1),
(2) Date: Aug. 8, 2019

(87) PCT Pub. No.: WO2019/140813

PCT Pub. Date: Jul. 25, 2019

(65) Prior Publication Data

US 2020/0040728 A1 Feb. 6, 2020

(30) Foreign Application Priority Data

Jan. 18, 2018 (CN) ..... 2018 1 0047635

(51) Int. Cl.
*E21F 15/02* (2006.01)
*E21C 41/18* (2006.01)
(Continued)

(52) U.S. Cl.
CPC ..... *E21F 15/02* (2013.01); *E21C 41/18* (2013.01); *E21D 20/00* (2013.01); *E21F 15/04* (2013.01); *E21F 15/08* (2013.01)

(58) Field of Classification Search
CPC ..... E21C 41/04; E21C 41/18; E21F 1/006; E21F 15/00; E21F 15/02; E21F 15/04
(Continued)

(56) References Cited

FOREIGN PATENT DOCUMENTS

| | | | |
|---|---|---|---|
| CN | 102943674 | A | 2/2013 |
| CN | 107313778 | A | 11/2017 |
| WO | 2019140813 | A1 | 7/2019 |

OTHER PUBLICATIONS

International Search Report (Form PCT/ISA/210) dated Jul. 30, 2018 issued in corresponding International Application No. PCT/CN2018/086556.

(Continued)

*Primary Examiner* — Sunil Singh
(74) *Attorney, Agent, or Firm* — Hauptman Ham, LLP

(57) ABSTRACT

Provided is a method of forming a roadway by filling gangue paste during wide roadway excavation of a thick coal seam belonging to the technical field of mining industry. The method comprises: firstly designing a width of a filing strip and a width of a new excavation roadway according to a geological condition of a coal seam; secondly, determining a length of each filling, i.e. a cyclic filling interval, according to an existing excavation technical condition of a mining shaft; when the new excavation roadway is excavated, performing supporting for a roof, a floor and an inner side of a roadway by using a strong bolt and bolt-mesh-cable; then, after the new excavation roadway is excavated for the cyclic filling interval, starting to perform roadway-expanding excavation along an outer side of the roadway; when roadway-expanding excavation is performed, performing temporary supporting for a filling strip and a junction of the filling strip and the new excavation roadway by using a single hydraulic prop in cooperation with a metal articulated roof beam; finally, after roadway-expanding excavation is completed, removing temporary supports and filling the (Continued)

filling strip; afterwards, the above steps are performed alternately. In this way, coal losses caused by reserving coal pillars can be effectively reduced, the impact of the underground pressure during roadway excavation is relieved and the costs of gangue treatment and roadway excavation are lowered.

10 Claims, 2 Drawing Sheets

(51) Int. Cl.
*E21D 20/00* (2006.01)
*E21F 15/04* (2006.01)
*E21F 15/08* (2006.01)

(58) Field of Classification Search
USPC ..... 299/11, 12, 19; 454/168, 171, 172
See application file for complete search history.

(56) References Cited

OTHER PUBLICATIONS

Written Opinion of the International Search Authority (Form PCT/ISA/237) dated Jul. 30, 2018 issued in corresponding International Application No. PCT/CN2018/086556.
Chinese Search Report dated Sep. 25, 2018 issued in corresponding Chinese Application No. 201810047635.5.
First Office Action dated Oct. 8, 2018 issued in corresponding Chinese Application No. 201810047635.5.

ROADWAY FORMING METHOD BY EXPANDING EXCAVATING AND FILLING GANGUE PASTE IN THICK COAL SEAM

RELATED APPLICATIONS

The present application is a National Phase of International Application Number PCT/CN2018/086556, filed May 11, 2018, and claims the priority of China Application No. 201810047635.5, filed Jan. 18, 2018.

TECHNICAL FIELD

The present disclosure relates to the technical field of mining industry and particularly to a method of forming a roadway by filling gangue paste during wide-roadway excavation of a thick coal seam.

BACKGROUND

At present, a roadway protection coal-pillar is reserved between working faces of mining districts of most mining areas in China with a purpose of preventing spontaneous combustion of coals caused by air leakage between a production (preparation) working face and an adjacent gob while reducing the influences of an underground pressure of the working face. Due to large underground pressures of thick coal seams, mechanical properties of the reserved coal pillars are changed, resulting in easy damage and instability. Also, those mining shafts for excavating thick coal seams produce a large quantity of gangues, resulting in mountains of gangues on the ground and bringing significant harm to the survival conditions and environments of the human.

A method of forming a roadway by filling gangue paste during wide-roadway excavation under a thick coal seam condition can effectively reduce coal losses caused by roadway protection coal pillars reserved at the time of excavating the thick coal seam.

SUMMARY

The subject of the present disclosure is to provide a method of forming a roadway by filling gangue paste during wide-roadway excavation of a thick coal seam to effectively reduce coal losses caused by reserved coal pillars, relieving the influence of an underground pressure at the time of excavating a roadway and lowering expenses of gangue treatment and roadway excavation.

To achieve the above purpose, it is desired to solve technical problems of how to determine ranges of a wide-roadway excavation and a filling region, how to fully maintain a condition of roadway stability and maintain airtightness of a gob under a precondition of maintaining the roadway stability, and how to perform temporary supporting for a filling strip. Under a precondition of maintaining safe and high efficiency production of a mining shaft, expenses of roadway excavation and gangue treatment and work load of a filling body can be effectively reduced, thereby lowering costs of mining shaft excavation.

To overcome the above technical problems, the present disclosure provides the following technical solution.

There is provided a method of forming a roadway by filling gangue paste during wide-roadway excavation of a thick coal seam, sequentially including the steps of:

step a: designing a width of a filling strip and a width of a new excavation roadway according to a geological condition of a coal seam;

step b: determining a length of each filling, i.e. cyclic filling interval, according to an existing excavation technical condition of a mining shaft;

step c: after the new excavation roadway is excavated for the cyclic filling interval, starting to perform roadway-expanding excavation along an outer side of the roadway; when a new excavation roadway is excavated, performing supporting for a roof, a floor and a roadway's inner side by using "bolt+bolt-mesh-cable"; when roadway-expanding excavation is performed, performing temporary supporting for a formed filling strip and a junction of the formed filling strip and the new excavation roadway by using a single hydraulic prop in cooperation with a metal articulated roof beam;

step d: after roadway-expanding excavation is completed, removing temporary supports and constructing an isolation wall with a double-layer plastic woven fabric at a side of the filling strip;

after the isolation wall is constructed, filling the filling strip with a filling pipeline, where the filling pipeline transports gangue pastes to the filling strip for filling; and step e: performing the steps a-d alternately.

The thick coal seam refers to a stable thick coal seam which has an inclination angle of less than 12 degrees, and stable in thickness and has no large fault.

The above solution brings a direct technical effect as follows: according to the manner of forming a roadway by filling gangue paste during wide-roadway excavation, wide-roadway excavation is adopted for roadway excavation at a mining preparation working face with coal pillars replaced with gangue paste so as to achieve a technical effect of coal-pillar-free excavation. Apparently, with advent of the technical idea and a practical application, coal losses caused by the reserved roadway protection coal pillars can be significantly reduced. At the same time, the impact of a superimposed supporting pressure generated by an adjacent roadway excavation can be solved and supporting difficulties and roadway deformation can be effectively reduced and also costs of gangue treatment can be lowered.

The technical difficult point of the above solution lies in that the coal seam is a thick coal seam that is relatively stable, and has an inclination angle of less than 12 degrees and the coal seam is stable in thickness and has no fault that has a large fall within the mining district. A law that the wide-roadway excavation method can be adopted for the thick coal seam during a roadway excavation under the precondition is discovered, and the law is a core point of the technical idea of the present disclosure. That is to say, such law or such discovery of the technical problem allows subsequent solution to be naturally smooth and straightforward.

A basis for reliability and effectiveness of the above technical idea is that: for a thick coal seam, timely supporting measures are required to be adopted for a section of the filling strip newly excavated to guarantee completeness of a roof of the filling strip. Thus, a safe and reliable working environment is provided for subsequent arrangement of the filling isolation wall and filling work. After completion of the filling work, a composite structure formed by the filling body and the coal body jointly supports the roof, recovering a large quantity of coal resources and protecting the roadway. Actually, calculation shows that the strength of the composite structure formed by the filling body and the coal body may satisfy the requirements of protecting the roadway.

It can be easily seen that the method of forming a roadway by filling gangue paste during wide-roadway excavation of a thick coal seam in the above technical solution can recover coal resources in a large quantity and effective solve the problem that mining of a thick coal seam brings high costs of gangue treatment and damages the ground surface and surrounding environment when the condition of the roadway stability and the filling region airtightness and the safe and high efficiency mining of a mining shaft is fully satisfied.

As a preferred solution of the present disclosure, the metal articulated roof beams are articulated together from front, back, left and right to form a stable one-piece body with the single hydraulic prop.

The above preferred technical solution brings the following effect directly as follows: the articulated roof beams are articulated together from front, back, left and right to form a stable one-piece body to bear a roof pressure, thereby increasing supporting strength and reducing potential hazards of the roof significantly. The single hydraulic prop has a strong supporting strength and good safety stability, which ensures good stability, high efficiency, simple operation and convenient maintenance during use.

As another preferred solution of the present disclosure, the single hydraulic prop is provided with a base.

The above preferred technical solution brings direct technical benefits as follows: a safety accident occurring due to the excavation face single hydraulic prop falling down due to impact of float coals and the like is prevented.

Preferably, at Step d, timber pillars are firstly used to support the filling strip before the temporary supports are removed.

The present disclosure brings technical benefits as follows:

a mixed structure of "filling body+coal body" is formed around the roadway by replacing the coal pillars with the gangues to effectively reduce the impact of the underground pressure. Also, the problems that the mining of the thick coal seam produces a large quantity of gangues, brings high costs of gangue treatment and severely damages the environment due to mountains of gangues on the ground and so on can be solved, thereby achieving green mining.

The method of forming a roadway by filling gangue paste during wide-roadway excavation under a thick coal seam condition may achieve an effect of coal-pillar-free excavation roadway, thereby effectively lowering excavation costs, improving working efficiency and increasing economic benefits.

BRIEF DESCRIPTION OF THE DRAWINGS

The present disclosure will be described further below in combination with the accompanying drawings.

Figure 1:
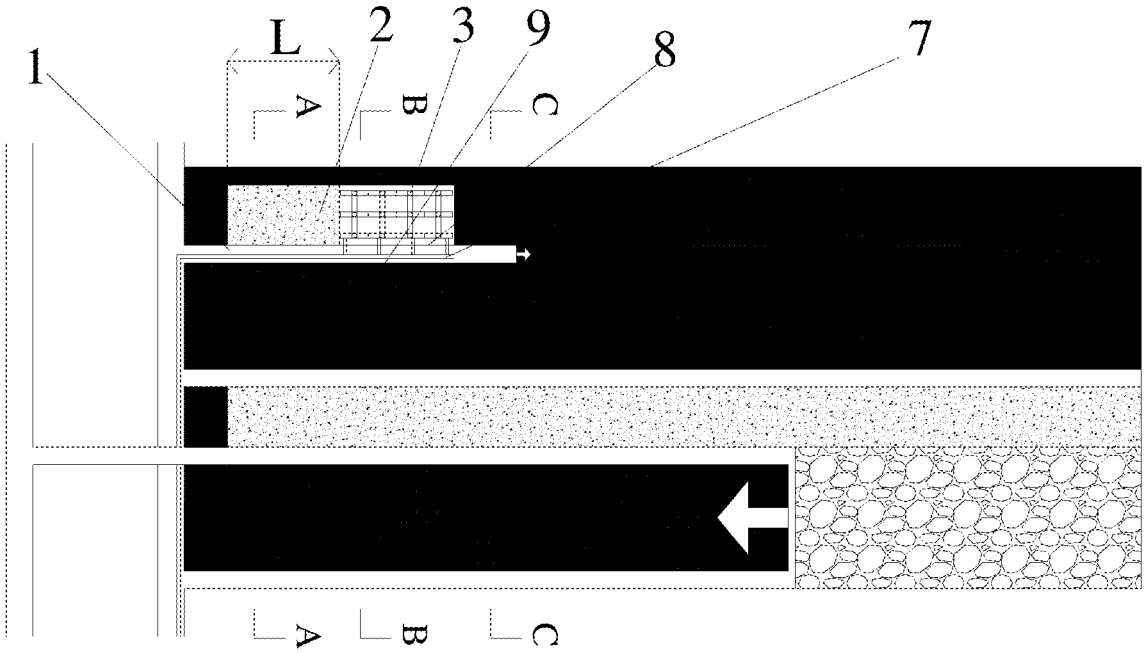
FIG. 1 is a principle diagram illustrating a method of performing wide roadway excavation in a thick coal seam according to an example of the present disclosure.

In the drawings, 1 refers to a new excavation roadway, 2 refers to a filling strip, 3 refers to a single hydraulic prop, 4 refers to a metal articulated roof beam, 5 refers to a strong bolt, 6 refers to an isolation wall, 7 refers to a filling pipeline, 8 refers to an outer side of a roadway, 9 refers to an inner side of a roadway, 10 refers to a roof, 11 refers to a floor and L refers to a cyclic filling interval.

DETAILED DESCRIPTION OF THE EMBODIMENTS

The present disclosure provides a system of filling gangue paste during wide-roadway excavation of a thick coal seam. To make the advantages and technical combination with specific examples.

Figure 2:
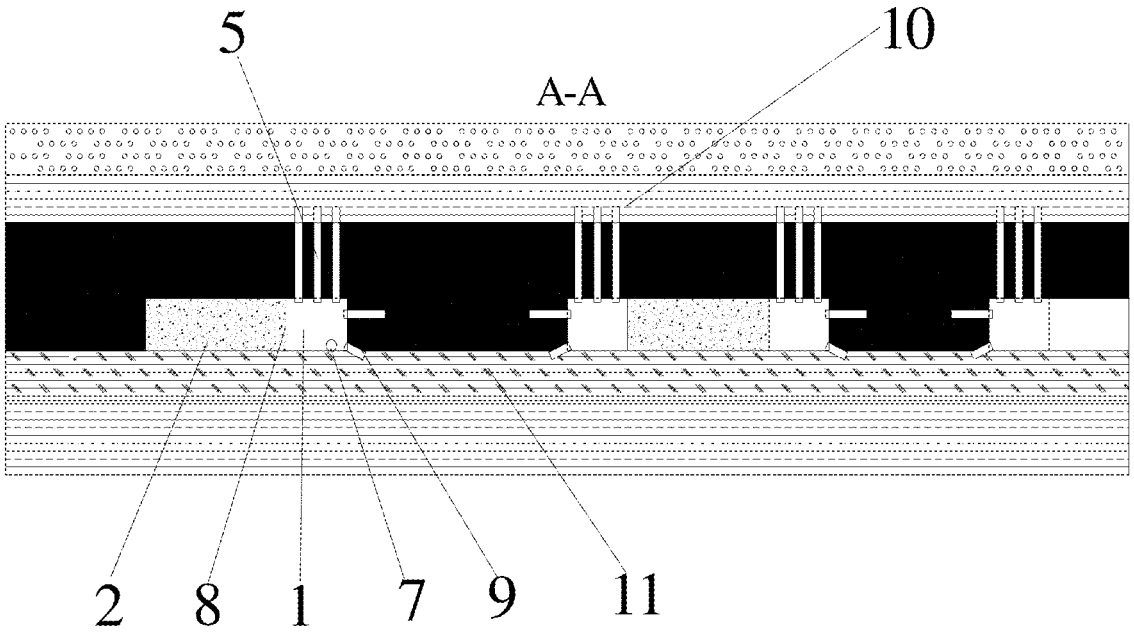
FIG. 2 is an A-A section view (filling is completed) of FIG. 1 of the present disclosure.
Figure 3:
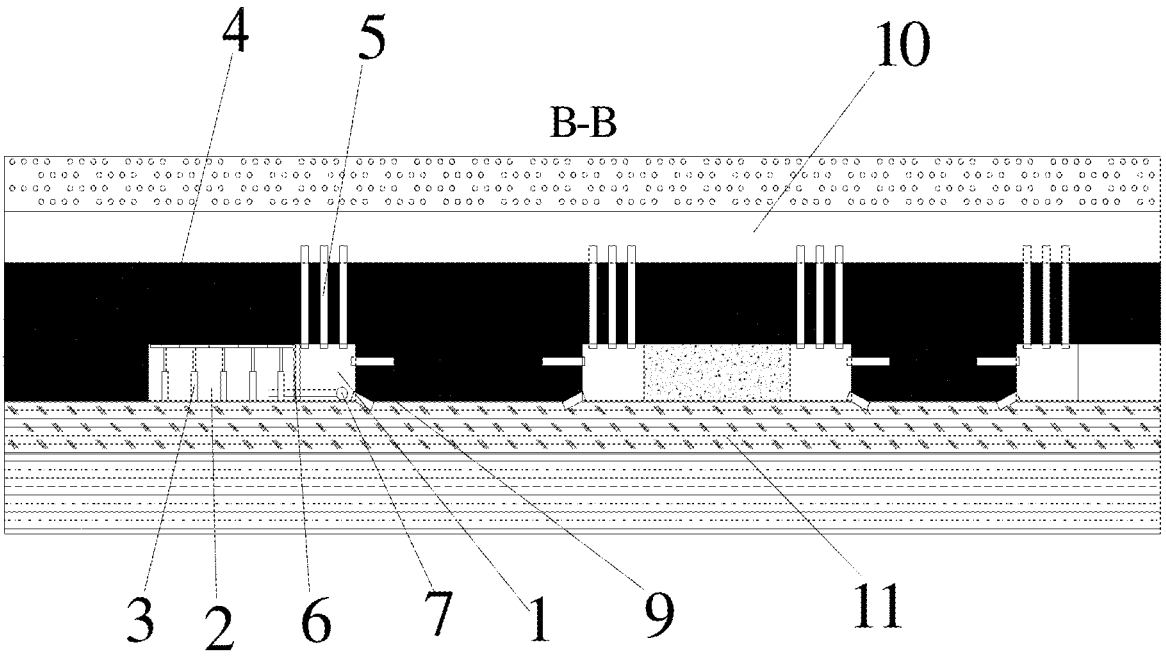
FIG. 3 is a B-B section view (roadway-expanding excavation is completed and filling is to be performed) of FIG. 1 of the present disclosure.
Figure 4:
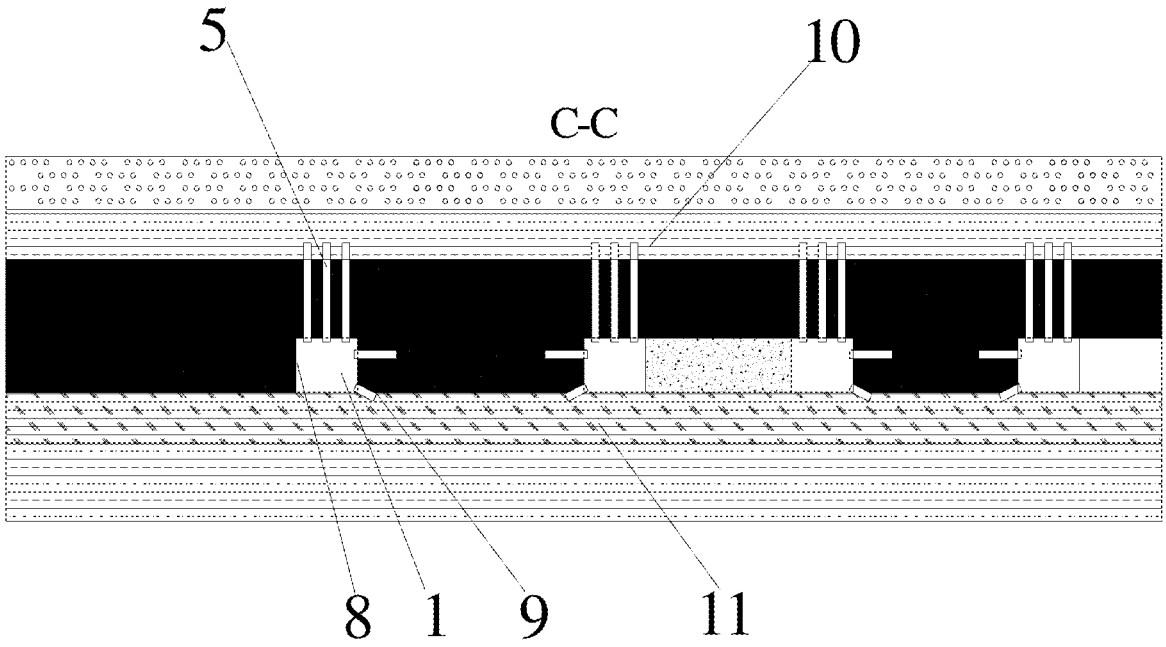
FIG. 4 is a C-C section view (excavation of a new excavation roadway) of FIG. 1 of the present disclosure.

Descriptions are made below in combination with FIGS. 1-4.

At step 1, it is determined that a filling strip 2 has a width of 9 m and a new excavation roadway 1 has a width of 4 m according a geological condition of a coal seam.

At step 2, a cyclic filling interval L is determined as 14 m according to an existing excavation technical condition. When the new excavation roadway 1 is excavated in a coal seam, a section size of the roadway is 4 m in width and 3 m in height. To ensure roadway stability, a strong bolt 5 is hammered for supporting while the new excavation roadway 1 is excavated. The bolt supporting refers to that strong bolts and cables are hammered on a roof 10, a floor 11, and an inner side 9 of the roadway and a rhombic wire mesh is hung on the tail of the bolt to reinforce the supporting effect.

When the new excavation roadway 1 is excavated to a length of 14 m, excavation of 14 m is performed along an outer side 8 of the roadway to form the filling strip 2 of 9 m. When a roadway-expanding excavation is performed, it is ensured that a space generated by the roadway-expanding excavation is paralleled to the new excavation roadway 1. After the roadway-expanding excavation is started, the excavation of the new excavation roadway 1 and the roadway-expanding excavation are alternately performed to advance cyclically, that is, the new excavation roadway 1 is excavated firstly for one segment, and then the roadway-expanding excavation is performed, so that a distance of the new excavation roadway 1 and an end of the filling strip 2 is maintained between 13-15 m.

At step 3, when the roadway-expanding excavation is performed, temporary supporting is performed for the formed filling strip 2 and a junction of the filling strip 2 and the new excavation roadway 1 by using the single hydraulic prop 3 in cooperation with a metal articulated roof beam 4. The single hydraulic prop "wears shoes". The metal articulated roof beams 4 are articulated together from front, back, left and right to form a stable one-piece body. After the temporary supporting is completed, a filling pipeline 7 is arranged in the new excavation roadway 1.

At step 4, after the roadway-expanding excavation is completed, the temporary supports are removed, dense timber supports are used for supporting at a side of the filling strip 2 and then an isolation wall 6 is constructed with a plastic woven fabric to form a closed filling space. The isolation wall 6 may be constructed based on the following measures: the plastic woven fabric is 20 m long and 4 m wide, a double-layer plastic woven fabric with a straw curtain rolled at an upper part is used and bound tightly with 15# iron wire at a spacing of 140 mm and then fixed on a timber pillar with an allowance of 1 m left at the bottom, and folded inwardly, and the allowance is compacted with woven bags fully loaded with gangues along the woven fabric after float coals on the floor are cleaned. It is guaranteed that the plastic woven fabric and the floor of a region to be filled are tightly attached.

After the filling isolation wall 6 is constructed, the gangue paste prepared by a filling station on the ground is filled into the filling strip 2 through the filling pipeline 7 in the new excavation roadway 1.

Afterwards, the above steps are performed alternately.

The present disclosure solves the problems that severe losses of coals are caused by reserving roadway-protection coal pillars in a traditional thick coal seam, the coal pillars are easily crisped or even crushed due to the impact of underground pressure during a gob or roadway excavation, easily resulting in spontaneous combustion of coal pillars in the gob, and imposing safety threat to the safe production and so on. Also, the combination of the filling mining technology and the gob-side roadway formation technology solves the problems of high costs of treatment for a large quantity of gangues produced during thick coal seam mining and harms caused to the environment and so on while improving the working efficiency and lowering production costs.

A part that is not mentioned in the present disclosure may be implemented by the prior art.

Although terms such as the single hydraulic prop and the metal articulated roof beam are used frequently in the present disclosure, the possibility of using other terms is not precluded. Simple substitutions made by those skilled in the art for these terms according to the teachings of the present disclosure shall all fall within the scope of protection of the present disclosure.

The invention claimed is:

1. A roadway forming method by expanding excavation and filling gangue paste in a thick coal seam, sequentially comprising the steps of:

a. designing a width of a filling strip and a width of a new excavation roadway according to a geological condition of the thick coal seam;

b. determining a cyclic filling interval as a length of each filling;

c. after the new excavation roadway is excavated for the cyclic filling interval, starting to perform the expanding excavation along an outer side of the new excavation roadway to generate the filling strip;

when the new excavation roadway is excavated, using a bolt and a bolt-mesh-cable as a support to support a roof, a floor and an inner side of the new excavation roadway;

when the expanding excavation is performed, using a single hydraulic prop in cooperation with a metal articulated roof beam as a temporary support to support the filling strip formed and a junction of the filling strip and the new excavation roadway;

d. after the expanding excavation is completed, removing the temporary support and constructing an isolation wall with a double-layer plastic woven fabric at a side of the filling strip;

after the isolation wall is constructed, filling the filling strip through a filling pipeline, wherein the filling pipeline transports the gangue paste to the filling strip; and e. performing steps a-d repeatedly;

wherein the thick coal seam refers to a stable coal seam has a thickness of greater than 3.5 m and less than 10 m when underground mining, an inclination angle of less than 12 degrees, and has no fault.

2. The roadway forming method by expanding excavation and filling gangue paste in the thick coal seam according to claim 1, wherein a plurality of the metal articulated roof beams are articulated together from front, back, left and right to form a stable one-piece body with a plurality of the single hydraulic prop.

3. The roadway forming method by expanding excavation and filling gangue paste in the thick coal seam according to claim 1, wherein the single hydraulic prop is provided with a base.

4. The roadway forming method by expanding excavation and filling gangue paste in the thick coal seam according to claim 1, wherein, at step d, timber pillars are firstly used to support the filling strip before the temporary support is removed.

5. The roadway forming method by expanding excavation and filling gangue paste in the thick coal seam according to claim 1, wherein in step d, the filling strip filled replaces a coal pillar for protection.

6. The roadway forming method by expanding excavation and filling gangue paste in the thick coal seam according to claim 5, wherein in step d, the filling strip filled replaces the coal pillar between working faces configured to achieve coal-pillar-free excavation.

7. The roadway forming method by expanding excavation and filling gangue paste in the thick coal seam according to claim 1, wherein in step d, the filling strip is paralleled to the new excavation roadway.

8. The roadway forming method by expanding excavation and filling gangue paste in the thick coal seam according to claim 7, wherein a height of the filling strip is equal to a height of the new excavation roadway.

9. The roadway forming method by expanding excavation and filling gangue paste in the thick coal seam according to claim 1, wherein in step d, filling the filling strip is through the filling pipeline in the new excavation roadway.

10. The roadway forming method by expanding excavation and filling gangue paste in the thick coal seam according to claim 1, wherein the roadway forming method is performed during first-mining.

* * * * *